US008753721B2

(12) United States Patent
Shimizu et al.

(10) Patent No.: US 8,753,721 B2
(45) Date of Patent: Jun. 17, 2014

(54) METHOD AND APPARATUS FOR PRODUCING THERMOSENSITIVE RECORDING MATERIAL

(75) Inventors: Tomohito Shimizu, Numazu (JP); Shuji Hanai, Numazu (JP); Hideyuki Kobori, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 379 days.

(21) Appl. No.: 12/726,560

(22) Filed: Mar. 18, 2010

(65) Prior Publication Data

US 2010/0239766 A1 Sep. 23, 2010

(30) Foreign Application Priority Data

Mar. 18, 2009 (JP) ..... 2009-065738

(51) Int. Cl.
*B05D 1/30* (2006.01)

(52) U.S. Cl.
USPC ..... 427/420; 427/372.2

(58) Field of Classification Search
USPC ..... 427/420, 372.2
See application file for complete search history.

(56) References Cited

U.S. PATENT DOCUMENTS

| | | | | |
|---|---|---|---|---|
| 3,404,025 | A * | 10/1968 | Wootten | 427/209 |
| 3,508,947 | A * | 4/1970 | Hughes | 430/538 |
| H1003 | H * | 12/1991 | Ishiwata et al. | 430/502 |
| 6,497,926 | B1 * | 12/2002 | Yokota et al. | 427/542 |
| 2003/0190432 | A1 * | 10/2003 | Yokota et al. | 427/420 |
| 2008/0069965 | A1 | 3/2008 | Kobori et al. | |
| 2008/0206496 | A1 | 8/2008 | Kobori et al. | |
| 2008/0226828 | A1 | 9/2008 | Shimizu et al. | |
| 2008/0234128 | A1 * | 9/2008 | Orihara et al. | 503/207 |

FOREIGN PATENT DOCUMENTS

| | | | |
|---|---|---|---|
| DE | 10033056 | | 1/2001 |
| EP | 1964686 | | 3/2008 |
| JP | 6-134378 | | 5/1994 |
| JP | 9-258368 | | 10/1997 |
| JP | 2858136 | | 12/1998 |
| JP | 2002127601 | A * | 5/2002 |
| JP | 2003-62517 | | 3/2003 |
| JP | 3953035 | | 5/2007 |

OTHER PUBLICATIONS

Jun. 11, 2010 European search report in connection with counterpart European patent application No. 10156798.
Japanese official action dated Jul. 2, 2013 in corresponding Japanese patent application No. 2010-046205.

* cited by examiner

*Primary Examiner* — Alexander Weddle
(74) *Attorney, Agent, or Firm* — Cooper & Dunham LLP

(57) ABSTRACT

A method containing: ejecting a coating liquid for a thermosensitive recording material from a slit, the coating liquid being formed of at least two layers; allowing the coating liquid to free-fall while guiding in the form of a curtain with a curtain edge guide; applying the coating liquid on a web which continuously travels; and drying the coating liquid to form a coated film, wherein the method uses a curtain coating method, the coating liquid contains a coating liquid of a thermosensitive recording layer and that of a layer adjacent to the thermosensitive recording layer, and dynamic surface tension A of the coating liquid of the thermosensitive recording layer and that B of the coating liquid of the layer has a difference (A–B) of 4 mN/m or less.

3 Claims, 3 Drawing Sheets

(Prior Art)

METHOD AND APPARATUS FOR PRODUCING THERMOSENSITIVE RECORDING MATERIAL

BACKGROUND OF THE INVENTION

1. Field of the Invention

The present invention relates to a method for producing a thermosensitive recording layer, in which a coated film is formed by a curtain coating method in which a coating liquid for a thermosensitive recording layer of at least two layers is ejected from a slit, the ejected coating liquid is allowed to free-fall while guiding the same with a curtain guide edge, and the coating liquid is applied on a web that continuously travels, and relates to an apparatus for producing a thermosensitive recording material.

2. Description of the Related Art

In the conventional production of a thermosensitive recording material, an under layer (heat insulation and filling of the web), a thermosensitive recording layer, and a protective layer have been successively applied one by one by blade coating, wire bar coating, rod bar coating, or the like.

However, a simultaneous multilayer coating has been currently carried out by a curtain coating.

The curtain coating is a coating method which is commonly used for the production of a photographic light sensitive material such as a photographic film. For example, as shown in FIG. 1, there is an extrusion curtain coating method (1) in which a coating liquid contained in a curtain coating head 1 is ejected from a nozzle slit 1*a*, a coating liquid film 3 which has been ejected and tends to shrink in the width direction due to the surface tension, is allow to free fall in the form of a curtain by being guided by a curtain edge guide 2, and the coating liquid film 3 is hit on a web 5 that continuously travels and optionally has a vacuum device 4 on the back thereof, to thereby form a coated film. Note that, in FIG. 1, 6 denotes a backup roller, and 7 denotes a liquid turning portion.

Moreover, as shown in FIG. 2, there is a slide hopper curtain coating method (2), in which a coating liquid contained in a coating head 8 is ejected from a slit 8*a*, and the ejected coating liquid is moved onto a slide plane 9, and then is allowed to free fall by a curtain edge guide 11 which is configured to guide the coating liquid in the form of a curtain, and a coating liquid film 12 is formed while the coating liquid is hit on the web 14 that continuously travels. Note that, in FIG. 2, 10 denotes an edge guide of a slide part, 13 denotes a vacuum device, 15 denotes a backup roller, and 16 denotes a liquid turning portion.

Moreover, in the multilayer coating, there is a method in which coating liquids each having different functions are respectively ejected from each nozzle, and the ejected coating liquids are allowed to free-fall by a curtain edge guide for guiding the coating liquids in the form of curtain, and a coated film is formed while hitting the coating liquids on a web that continuously travels, or there is a method in which coating liquids each having different functions are ejected from a slit, the ejected coating liquids are laminated on the slide plane, the laminated coating liquids are allowed to free-fall by a curtain edge guide for guiding the coating liquids in the form of a curtain, and a coated film is formed while hitting the coating liquids on the web that continuously travels.

In the production of the thermosensitive recording material, among the coating defects occurred in the simultaneous multilayer curtain coating, there is a defect in which a curtain is split, and the split portion is elongated and turned by the web so that there is a portion where the coating liquid is not deposited in the shape of oval or stream line having a width of 3 mm to 10 mm and a length of 20 mm to 30 mm (this defect may be referred as "white spot" hereinafter).

When this defect is occurred, in the case of the thermosensitive recording material, there is a problem such that the portion which originally should be printed would not be colored by the printing using a thermal printer, as the thermosensitive recording layer does not exist there due to the white spot.

As a result of various studied and researches for preventing "white spots", the present inventors has found out that occurrences of "white spots" can be suppressed by controlling a difference in the dynamic surface tension of the thermosensitive recording layer and the layer adjacent to the thermosensitive recording layer.

In the field of the simultaneous multilayer curtain coating, there has been proposed to control the dynamic surface tension of the coating liquid for the purpose of stabilizing the curtain film (see Japanese Patent Application Laid-Open (JP-A Nos. 2004-181459 and 03-94871).

In JP-A No. 2004-181459, it has been proposed that, in the case of the simultaneous coating of three or more layers, the dynamic surface tension of an intermediate layer be made larger than that of the undermost layer and/or the uppermost layer by 5 or more. Moreover, in JP-A No. 03-94871, it has been proposed that, in the case of the simultaneous coating of multiple layers, the difference between the dynamic surface tension of the undermost layer and that of the uppermost layer be made small such as 10 mN/m or less.

One proposes the difference be made large, and the other proposes the difference be made small. Therefore, these two technical concepts are not basically compatible with the concept of the present invention.

Specifically, JP-A No. 2004-181459 does not disclose the specific ranges of the dynamic surface tension of the undermost layer and uppermost layer to achieve the difference between the dynamic surface tension of the intermediate layer and that of the undermost layer and/or the uppermost layer to be 5 or more, as well as the reason why the difference is made lager by 5 or more. Accordingly, it cannot presume the technical meaning of the feature such that the difference in the surface tension to be made large.

Also, JP-A No. 03-94871 does not disclose the technical meaning in that the difference between the dynamic surface tension of the uppermost layer and that of the undermost layer is made 10 mN/m or less. In addition, both of the aforementioned patent literatures do not disclose the difference between the dynamic surface tension of the thermosensitive recording layer and that of the layer adjacent to the thermosensitive recording layer.

To compare with them, the present invention has paid attention to the difference between the dynamic surface tension of the thermosensitive recording layer and that of the layer adjacent to the thermosensitive recording layer, and thus, in the case of the simultaneous multilayer coating of three or more layers, it is not directly relevant to the difference the dynamic surface tension of the uppermost layer and that of the undermost layer to be 10 mN/m or less.

BRIEF SUMMARY OF THE INVENTION

An object of the present invention is to provide a method and apparatus for producing a thermosensitive recording material, which can stably and continuously produce a thermosensitive recording material for a long period of time without forming "white spots" that is caused by a split of curtain during the simultaneous coating of a multilayered curtain in the production of the thermosensitive recording material.

The present inventors have found that the object of the present invention can be achieved by adjusting a coating liquid of a thermosensitive recording layer and a coating liquid of a layer adjacent to the thermosensitive recording layer so that the difference (A–B) of the dynamic surface tension A of the coating liquid of the thermosensitive recording layer and the dynamic surface tension B of the coating liquid of the layer adjacent to the thermosensitive recording layer is to be 4 mN/m or less based upon the functional mechanism verified in the present invention.

The present invention is based upon the insights of the present inventors, and the means for solving the aforementioned problems are as follows:

<1> A method for producing a thermosensitive recording material, containing:

ejecting a coating liquid for a thermosensitive recording material from a slit, the coating liquid is formed of at least two layers;

allowing the ejected coating liquid to free-fall while guiding the ejected coating liquid in the form of a curtain with a curtain edge guide;

applying the coating liquid on a web which continuously travels; and drying the applied coating liquid so as to form a coated film, wherein the method uses a curtain coating method, and wherein the coating liquid for the thermosensitive recording medium contains a coating liquid of a thermosensitive recording layer and a coating liquid of a layer adjacent to the thermosensitive recording layer, and dynamic surface tension A of the coating liquid of the thermosensitive recording layer and dynamic surface tension B of the coating liquid of the layer adjacent to the thermosensitive recording layer has a difference (A–B) of 4 mN/m or less.

<2> The method for producing a thermosensitive recording material according to <1>, wherein, when the coating liquid free-falling in the form of the curtain contains the coating liquid of the thermosensitive recording layer, and the coating liquid of the layer adjacent to the thermosensitive recording layer in this order from the side of a coating device, the dynamic surface tension of the coating liquid of the thermosensitive recording layer is larger than that of the coating liquid of the layer adjacent to the thermosensitive recording layer, and wherein, when the coating liquid free-falling in the form of the curtain contains the coating liquid of the layer adjacent to the thermosensitive recording layer, and the coating liquid of the thermosensitive recording layer in this order from the side of a coating device, the dynamic surface tension of the coating liquid of the layer adjacent to the thermosensitive recording layer is larger than that of the coating liquid of the thermosensitive recording layer.

<3> The method for producing a thermosensitive recording material according to <1>, wherein the coating liquid free-falling in the form of the curtain contains the coating liquid of the thermosensitive recording layer, and the coating liquid of the layer adjacent to the thermosensitive recording layer n this order from the side of a coating device, and the coating liquid is applied so that the dynamic surface tension A of the coating liquid of the thermosensitive recording layer and the dynamic surface tension B of the coating liquid of the layer adjacent to the thermosensitive recording layer has a difference (A–B) of 4 mN/m or less.

<4> The method for producing a thermosensitive recording material according to any one of <I> to <3>, wherein the coating liquid for the thermosensitive recording material contains a coating liquid for three or more layers, including the thermosensitive recording layer, and the coating liquid is applied in accordance with a multilayer simultaneous curtain coating method.

<5> An apparatus for producing a thermosensitive recording material, containing:

a curtain coating unit containing: a slit configured to eject a coating liquid for a thermosensitive recording material formed of at least two layers, a curtain guide edge configured to guide the ejected coating liquid, which is allowed to free-fall, in the form of a curtain; and a web which continuously travels and on which the coating liquid is applied, followed by drying so as to form a coated film, wherein the coating liquid for the thermosensitive recording material contains a coating liquid of a thermosensitive recording layer and a coating liquid of a layer adjacent to the thermosensitive recording layer, and dynamic surface tension A of the coating liquid of the thermosensitive recording layer and dynamic surface tension B of the coating liquid of the layer adjacent to the thermosensitive recording layer has a difference (A–B) of 4 mN/m or less.

<6> The apparatus for producing a thermosensitive recording material according to <5>, further containing a slide hopper curtain nozzle.

According to the method for producing a thermosensitive recording layer as defined in any one of <1> to <4> and the apparatus for producing a thermosensitive recording layer as defined in any of <5> or <6>, occurrence of white spots, that is a problem in the simultaneous multilayer curtain coating, can be suppressed.

Moreover, according to the present invention, it has been found that, in the simultaneous multilayer curtain coating, the result can be attained as if an under layer is protected by an upper layer, by covering the under layer that has large dynamic surface tension and tends to cause the shrinkage of the film with the upper layer that has small dynamic surface tension, but this relationship is lost when the difference in the dynamic surface is significantly large.

DETAILED DESCRIPTION OF THE INVENTION

Method for Producing Thermosensitive Recording Material

A method for producing a thermosensitive recording material of the present invention contains: ejecting a coating liquid for a thermosensitive recording material from a slit, the coating liquid is so formed of at least two layers; allowing the ejected coating liquid to free-fall while guiding the ejected coating liquid in the form of a curtain with a curtain edge guide; applying the coating liquid on a web which continuously travels; and drying the applied coating liquid so as to form a coated film, wherein the method uses a curtain coating method, and wherein the coating liquid for the thermosensitive recording medium contains a coating liquid of a thermosensitive recording layer and a coating liquid of a layer adjacent to the thermosensitive recording layer, and dynamic surface tension A of the coating liquid of the thermosensitive recording layer and dynamic surface tension B of the coating liquid of the layer adjacent to the thermosensitive recording layer has a difference (A−B) of 4 mN/m or less. As a result of this, the occurrence of white spots can be suppressed.

When the difference (A−B) in the dynamic surface tension thereof is more than 4 mN/m, it is difficult to attain uniform the dynamic surface tension in the entire portion of the curtain film due to the variation in the production processes and the like, though it is ideal to have the uniform dynamic surface tension. If there is any portion having uneven surface tension within the curtain film, the split of the curtain tends to occur. The larger the difference in the surface tension is, more likely the portion having larger surface tension is repelled at the time when the split of the curtain is occurred in the uneven portion, resulted in the split of the curtain and occurrence of white spots.

In the case where the coating liquid free-falling in the form of the curtain has the thermosensitive recording layer and the layer adjacent to the thermosensitive recording layer in this order from the side of the coating device (in the case where the thermosensitive recording layer is an under layer), occurrence of white spots can be suppressed by adjusting the dynamic surface tension so that the dynamic surface tension of the coating liquid of the thermosensitive recording layer is to be larger than that of the coating liquid of the layer adjacent to the thermosensitive recording layer.

Figure 2:
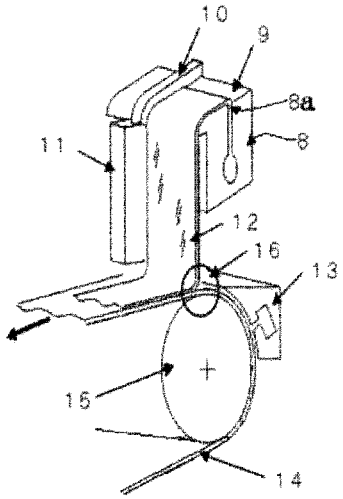
FIG. 2 (Prior Art)
FIG. 2 is a schematic diagram showing an apparatus for producing a thermosensitive recording material in a curtain coating method of slight hopper type.

In the case where the thermosensitive recording layer is present as the under layer, and the relationship of the dynamic surface tension of the coating liquids (the dynamic surface tension of the coating liquid of the thermosensitive recording layer>the dynamic surface tension of the coating liquid of the layer adjacent to the thermosensitive recording layer) is reversed, the contracted flow occurs to the adjacent upper layer on the slide plane, especially in the case of the slide hopper curtain coating shown in FIG. 2, and a curtain film itself cannot be formed.

On the other hand, in the case where the coating liquid free-falling in the form of the curtain has the layer adjacent to the thermosensitive recording layer and the thermosensitive recording layer n this order from the side of the coating device (in the case where the thermosensitive recording layer is an upper layer), the dynamic surface tension of the coating liquid of the layer adjacent to the thermosensitive layer is larger than that of the coating liquid of the thermosensitive recording layer.

In the case where the thermosensitive recording layer is present as the upper layer and the relationship of the dynamic tension of the coating liquids (the dynamic surface tension of the coating liquid of the layer adjacent to the thermosensitive recording layer>the dynamic surface tension of the coating liquid of the thermosensitive recording layer) is reversed, the contracted flow occurs to the adjacent upper layer on the slide plane, especially in the case of the slide hopper curtain coating shown in FIG. 2, and a curtain film itself cannot be formed.

Moreover, the occurrence of white spots can also be suppressed by arranging the coating liquid free-falling in the form of the curtain to have the thermosensitive recording layer and the layer adjacent to the thermosensitive recording layer in this order from the side of the coating device, and applying the coating liquid so that the dynamic surface tension A of the coating liquid of the thermosensitive recording layer and the dynamic surface tension B of the coating liquid of the layer adjacent to the thermosensitive recording layer has a difference (A−B) of 4 mN/m or less.

Here, the method for measuring the dynamic surface tension is suitably selected depending on the intended purpose without any restriction. The dynamic surface tension of the coating liquid preferably uses the value measured in accordance with a curtain splitting method in which a difference in the dynamic surface tension was directly measured using a curtain film (see Kistler and Schweizer, LIQUID FILM COATING, pp. 113-114, CHAPMAN&HALL).

Figure 3A:
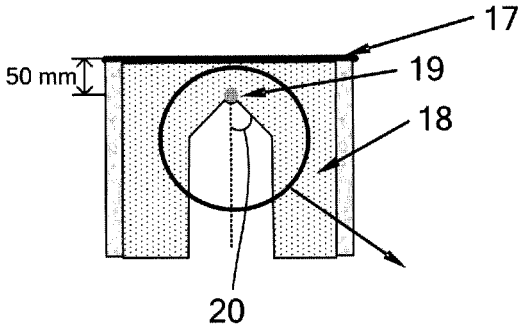
FIGS. 3A and 3B are diagrams specifically showing a measuring method for dynamic surface tension.
Figure 3B:
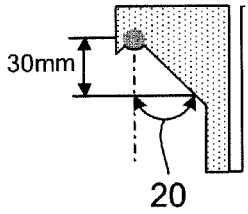

Specifically, a curtain film is formed using a curtain die shown in FIGS. 3A and 3B, and the curtain film 18 is split and the split angle 20 is measured in the following conditions for forming a curtain film, and measuring position. Then, the dynamic surface tension is calculated based on the following mathematical formula 1.

Condition for forming a curtain film: 2 cc/(cm·sec)

Measuring position:

position in width direction: center in the die width direction position in height direction: position distance from the edge of the die lip by 50 mm $$\sigma = \frac{\rho Q}{2} V \sin^2 \alpha$$

Mathematical Formula 1

Note that, in the mathematical formula 1, σ denotes dynamic surface tension, ρ denotes liquid density, Q denotes a flow rate per unit width, V denotes falling velocity of the curtain at split point, and α denotes a split angle. In FIG. 3A, 17 denotes a die lip edge, 19 denotes a needle having a diameter of 0.5 mm, and FIG. 3B illustrates the enlarged portion of the curtain film 18 at which the curtain film is split, and shows that the split angle 20 is measured at the point which is distant from the center of the needle by 30 mm.

Moreover, the curtain coating is suitably selected without any restriction, provided that a curtain film is formed and applied to a support. Examples thereof include an over board system in which a curtain film for free-falling is formed wider than the width of the support, and the coating liquid present outside the support is collected, and an inner board system in which a curtain film for free-falling is formed narrower than the width of the support, and the whole amount of the coating liquid ejected from a curtain nozzle is applied on the support.

The viscosity (B-type viscometer, at 25° C.) of the coating liquid for use in the curtain coating is preferably 50 mPa·s to 500 mPa·s, more preferably 100 mPa·s to 400 mPa·s. When the viscosity of the coating liquid is less than 50 mPa·s, the coating liquids are mixed to each other, causing the lowering of the sensitivity and the like. When the viscosity thereof is more than 500 mPa·s, a difference may be formed between the flow rate of the coating liquid adjacent to the edge guide of the curtain nozzle and the flow rate of the center portion of the coating liquid, resulted in the increased deposition amount at the coated edge portion, causing a rising phenomenon.

In the thermosensitive recording material, the web is suitably selected depending on the intended purpose without any restriction regarding the shape, structure and size thereof. For example, the shape of the web is a plate shape or the like. The structure of the web may be a single layer structure or a laminate structure, and the size of the web is suitably selected depending on the size of the thermosensitive recording material.

The material of the web is suitably selected depending on purpose without any restriction. As for the material thereof, various inorganic materials or organic materials can be used.

Examples of the inorganic material include glass, quartz, silicon, silicon oxide, aluminum oxide, $SiO_2$, and metal.

Examples of the organic material include: paper such as wood free paper, art paper, coated paper, and synthesized paper; cellulose derivatives such as cellulose triacetate; and polymer films formed of a polyester resin such as polyethylene terephthalate (PET) and polybutylene terephthalate, or polymers such as polycarbonate, polystyrene, polymethyl methacrylate, polyethylene, and polypropylene. These may be used independently, or in combination. Among them, wood free paper, art paper, coated paper and polymer paper are particularly preferable.

It is preferred that the web be surface-treated by corona discharge, oxidation reaction (with chromic acid and the like), etching, processing for improving adhesion, processing for antistatic, or the like for the purpose of improving the adhesion between the coating liquid and the web. Moreover, it is preferred that the support be colored in white by adding a white pigment such as titanium oxide and the like.

The thickness of the web is suitably selected depending on the intended purpose without any restriction, and is preferably 50 μm to 2,000 μm, more preferably 100 μm to 1,000 μm.

The undercoat layer is suitably selected depending on the intended purpose, provided that it is formed of a material capable of filling a surface of the web. It is preferred that the undercoat layer contain a binder resin and plastic hollow particles, and may further contain other substance, as necessary.

Each of the plastic hollow particles has a shell made of thermoplastic resin and contains therein air or other gas. They are fine hollow particles already in a foamed state, and the average particle diameter (outer particle diameter) is preferably 0.2 μm to 20 μm, more preferably 2 μm to 5 μm. When the average particle diameter is less than 0.2 μm, it is technically difficult to make particles hollow and the function of the under layer becomes insufficient. On the other hand, when the above diameter is more than 20 μm, the dried coating surface degrades in smoothness. Thus, the coated thermosensitive recording layer becomes non-uniform, and it is required to apply larger amount of thermosensitive recording layer coating liquid than necessary in order to provide a uniform layer. Accordingly, the plastic hollow particles preferably have a sharp distribution peak with little variation as well as an average particle diameter falling within the aforementioned range.

Furthermore, the above-described hollow particles preferably have a hollow ratio of 30% to 95%, particularly preferably 80% to 95%. In particles with a hollow ratio of less than 30%, thermal insulating properties are insufficient. Thus, heat energy from the thermal head is emitted to the outside of the thermosensitive recording material via the support, resulting in that the effect of improving sensitivity becomes inadequate. The hollow ratio referred to herein is the ratio of the inner diameter (the diameter of the hollow part) of the hollow particles to the outer diameter, and can be expressed by the following equation:

$$\text{Hollow ratio}=(\text{inner diameter of the hollow particles}/\text{outer diameter of the hollow particles})\times 100$$

As described above, each of the hollow microparticles has a shell of thermoplastic resin. Examples of the thermoplastic resin include styrene-acrylic resins, polystyrene resins, acrylic resins, polyethylene resins, polypropylene resins, polyacetal resins, chlorinated polyether resins, vinyl polychloride resins, and copolymer resins whose main components are vinylidene chloride and acrylonitrile. Also, as thermoplastic materials, examples include phenol formaldehyde resins, urea formaldehyde resins, melamine formaldehyde resins, furan resins, unsaturated polyester resin produced through addition polymerization and crosslinked MMA resin. Of these, styrene/acrylic resin and copolymer resins whose main components are vinylidene chloride and acrylonitrile are suitable for blade coating, since the hollow ratio is high and the variation in particle diameters is small.

The coating amount of the plastic hollow particles needs to be 1 g to 3 g per square meter of the support in order to maintain sensitivity and coating uniformity. When the coating amount is less than 1 $g/m^2$, sufficient sensitivity may not be attained. Whereas when the coating amount is more than 3 $g/m^2$, layer adhesiveness may decrease.

The thermosensitive recording layer contains a leuco dye and a developer, and may further contain other substances as necessary.

The leuco dye is a compound exhibiting electron donation properties, and may be used independently or in combination. However, the leuco dye itself is a colorless or light-colored dye precursor, and commonly known leuco compounds can be used, for example triphenylmethane phthalide compounds, triarylmethane compounds, fluoran compounds, phenothiazine compounds, thiofluoran compounds, xanthen compounds, indolyl phthalide compounds, spiropyran compounds, azaphthalide compounds, chlormenopirazole compounds, methyne compounds, rhodamine anilinolactum compounds, rhodamine lactum compounds, quinazoline compounds, diazaxanthen compounds, bislactone compounds and the like. In consideration of color development property, fogging of the background, and color fading of the image due to moisture, heat or light radiation, specific examples of such compounds are as follows.

In view of the chromogenic property, fading of the imaging part due to humidity, heat and light, and quality of the image with respect to fogging on the back ground, examples of such compounds include 2-anilino-3-methyl-6-diethyl amino fluoran, 2-anilino-3-methyl-6-(di-n-butyl amino) fluoran, 2-anilino-3-methyl-6-(di-n-pentyl amino) fluoran, 2-anilino-3-methyl-6-(N-n-propyl-N-methyl amino) fluoran, 2-anilino-3-methyl-6-(N-isopropyl-N-methyl amino) fluoran, 2-anilino-3-methyl-6-(N-isobutyl-N-methyl amino) fluoran, 2-anilino-3-methyl-6-(N-n-amyl-N-methyl amino) fluoran, 2-anilino-3-methyl-6-(N-sec-butyl-N-ethyl amino) fluoran, 2-anilino-3-methyl-6-(N-n-amyl-N-ethyl amino) fluoran, 2-anilino-3-methyl-6-(N-iso-amyl-N-ethyl amino) fluoran, 2-anilino-3-methyl-6-(N-cyclohexyl-N-methyl amino) fluoran, 2-anilino-3-methyl-6-(N-ethyl-p-toluidino) fluoran, 2-anilino-3-methyl-6-(N-methyl-p-toluidino) fluoran, 2-(m-trichloro methyl anilino)-3-methyl-6-diethyl amino fluoran, 2-(m-trifluoro methyl anilino)-3-methyl-6-diethyl amino fluoran, 2-(m-trifluoro methyl anilino)-3-methyl-6-(N-cyclohexyl-N-methyl amino) fluoran, 2-(2,4-dimethyl anilino)-3-methyl-6-diethyl amino fluoran, 2-(N-ethyl-p-toluidino)-3-methyl-6-(N-ethyl anilino) fluoran, 2-(N-methyl-p-toluidino)-3-methyl-6-(N-propyl-p-toluidino) fluoran, 2-anilino-6-(N-n-hexyl-N-ethyl amino) fluoran, 2-(o-chloranilino)-6-diethyl amino fluoran, 2-(o-bromoanilino)-6-diethyl amino fluoran, 2-(o-chloranilino)-6-dibutyl amino fluoran, 2-(o-fluoroanilino)-6-dibutyl amino fluoran, 2-(m-trifluoro methyl anilino)-6-diethylamino fluoran, 2-(p-acetyl anilino)-6-(N-n-amyl-N-n-butyl amino) fluoran, 2-benzyl amino-6-(N-ethyl-p-toluidino) fluoran, 2-benzyl amino-6-(N-methyl-2,4-dimethyl anilino) fluoran, 2-benzyl amino-6-(N-ethyl-2,4-dimethyl anilino) fluoran, 2-dibenzyl amino-6-(N-methyl-p-toluidino) fluoran, 2-dibenzyl amino-6-(N-ethyl-p-toluidino) fluoran, 2-(di-p-methyl benzyl amino)-6-(N-ethyl-p-toluidino) fluoran, 2-(α-phenyl ethyl amino)-6-(N-ethyl-p-toluidino) fluoran, 2-methyl amino-6-(N-methyl anilino) fluoran, 2-methyl amino-6-(N-ethyl anilino) fluoran, 2-methyl amino-6-(N-propyl anilino) fluoran, 2-ethyl amino-6-(N-methyl-p-toluidino) fluoran, 2-methyl amino-6-(N-methyl-2,4-dimethyl anilino) fluoran, 2-ethyl amino-6-(N-methyl-2,4-dimethyl anilino) fluoran, 2-dimethyl amino-6-(N-methyl anilino) fluoran, 2-dimethyl amino-6-(N-ethyl anilino) fluoran, 2-diethyl amino-6-(N-methyl-p-toluidino) fluoran, benzo leuco methylene blue, 2-[3,6-bis(diethyl amino)]-6-(o-chloranilino) xanthyl benzoic acid lactum, 2-[3,6-bis(diethyl amino)]-9-(o-chloranil no) xanthyl benzoic acid lactum, 3,3-bis(p-dimethyl amino phenyl) phtahlide, 3,3-bis(p-dimethyl amino phenyl)-6-dimethyl amino phthalide, 3,3-bis(p-dimethyl amino phenyl)-6-diethyl amino phthalide, 3,3-bis(p-dimethyl amino phenyl)-6-chlorphthalide, 3,3-bis(p-dibutyl amino phenyl) phthalide, 3-(2-methoxy-4-dimethyl amino phenyl)-3-(2-hydroxy-4,5-dichlorophenyl) phthalide, 3-(2-hydroxy-4-dimethyl amino phenyl)-3-(2-methoxy-5-chlorophenyl) phthalide, 3-(2-hydroxy-4-dimethoxy amino phenyl)-3-(2-methoxy-5-chlorophenyl) phthalide, 3-(2-hydroxy-4-dimethoxy amino phenyl)-3-(2-methoxy-5-nitrophenyl) phthalide, 3-(2-hydroxy-4-diethyl amino phenyl)-3-(2-methoxy-5-methyl phenyl) phthalide, 3,6-bis(dimethyl amino) fluorenespiro (9,3')-6'-dimethyl amino phthalide, 6'-chloro-8'-methoxy-benzoindolino spiropyran, and 6'-bromo-2'-methoxy benzoindolino spiropyran.

The amount of the leuco dye contained in the thermosensitive recording layer is preferably 5% by mass to 20% by mass, more preferably 10% by mass to 15% by mass.

Also, as the developer used in the present invention, various electron accepting substances are suitable which react with the aforementioned leuco dye at the time of heating and cause this to develop colors. Examples thereof include phenolic compounds, organic or inorganic acidic compounds and esters or salts thereof.

Specific examples thereof include bisphenol A, tetrabromobisphenol A, gallic acid, salicylic acid, 3-isopropyl salicylate, 3-cyclohexyl salicylate, 3-5-di-tert-butyl salicylate, 3,5-di-α-methyl benzyl salicylate, 4,4'-isopropylidenediphenol, 1,1'-isopropylidene bis (2-chlorophenol), 4,4'-isopropylene bis(2,6-dibromophenol), 4,4'-isopropylidene bis(2,6-dichlorophenol), 4,4'-isopropylidene his (2-methyl phenol), 4,4'-isopropylidene his (2,6-dimethyl phenol), 4,4'-isopropylidene bis(2-tert-butyl phenol), 4,4'-sec-butylidene diphenyl, 4,4'-cyclohexylidene bisphenol, 4,4'-cyclohexylidene his (2-methyl phenol), 4-tert-butyl phenol, 4-phenyl phenol, 4-hydroxy diphenoxide, α-naphthol, (3-naphthol, 3,5-xylenol, thymol, methyl-4-hydroxybenzoate, 4-hydroxyacetophenone, novolak phenol resins, 2,2'-thio his (4,6-dichloro phenol), catechol, resorcin, hydroquinone, pyrogallol, fluoroglycine, fluoroglycine carboxylate, 4-tert-octyl catechol, 2,2'-methylene his (4-chlorophenol), 2,2'-methylene his (4-methyl-6-tert-butyl phenol), 2,2'-dihydroxy diphenyl, ethyl p-hydroxybenzoate, propyl p-hydroxybenzoate, butyl p-hydroxybenzoate, benzyl p-hydroxybenzoate, p-hydroxybenzoate-p-chlorobenzyl, p-hydroxybenzoate-o-chlorobenzyl, p-hydroxybenzoate-p-methylbenzyl, p-hydroxybenzoate-n-octyl, benzoic acid, zinc salicylate, 1-hydroxy-2-naphthoic acid, 2-hydroxy-6-naphthoic acid, 2-hydroxy-6-zinc naphthoate, 4-hydroxy diphenyl sulphone, 4-hydroxy-4'-chloro diphenyl sulfone, bis (4-hydroxy phenyl) sulfide, 2-hydroxy-p-toluic acid, 3,5-di-tert-zinc butyl salicylate, 3,5-d tert-tin butyl salicylate, tartaric acid, oxalic acid, maleic acid, citric acid, succinic acid, stearic acid, 4-hydroxyphthalic acid, boric acid, thiourea derivatives, 4-hydroxy to thiophenol derivatives, his (4-hydroxyphenyl) acetate, bis (4-hydroxyphenyl)ethyl acetate, his (4-hydroxyphenyl) acetate-n-propyl, his (4-hydroxyphenyl) acetate-n-butyl, his (4-hydroxyphenyl) phenyl acetate, his (4-hydroxyphenyl) benzyl acetate, his (4-hydroxyphenyl) phenethyl acetate, bis (3-methyl-4-hydroxyphenyl) acetate, his (3-methyl-4-hydroxyphenyl) methyl acetate, his (3-methyl-4-hydroxyphenyl) acetate-n-propyl, 1,7-his (4-hydroxyphenylthio) 3,5-dioxaheptane, 1,5-bis (4-hydroxyphenylthio) 3-oxaheptane, 4-hydroxy phthalate dimethyl, 4-hydroxy-4'-methoxy diphenyl sulfone, 4-hydroxy-4'-ethoxy diphenyl sulfone, 4-hydroxy-4'-isopropoxy diphenyl sulfone, 4-hydroxy-4'-propoxy diphenyl sulfone, 4-hydroxy-4'-butoxy diphenyl sulfone, 4-hydroxy-4'-isopropoxy diphenyl sulfone, 4-hydroxy-4'-sec-butoxy diphenyl sulfone, 4-hydroxy-4'-tert-butoxy diphenyl sulfone, 4-hydroxy-4'-benzyloxy diphenyl sulfone, 4-hydroxy-4'-phenoxy diphenyl sulfone, 4-hydroxy-4'-(m-methyl benzoxy) diphenyl sulfone, 4-hydroxy-4'-(p-methyl benzoxy) diphenyl sulfone, 4-hydroxy-4'-(o-methyl benzoxy) diphenyl sulfone, 4-hydroxy-4'-(p-chloro benzoxy) diphenyl sulfone and 4-hydroxy-4'-oxyaryl diphenyl sulfone.

In the thermosensitive recording layer, the mixing ratio of the leuco dye to the developer (1 part by mass) is preferably 0.5 parts by mass to 10 parts by mass, particularly preferably 1 part by mass to 5 parts by mass.

Besides the above-described leuco dye and developer, it is possible to appropriately add, to the thermosensitive recording layer, other materials customarily used in thermosensitive recording materials, such as a binder, a filler, a thermoplastic material, a crosslinking agent, a pigment, a surfactant, a fluorescent whitening agent and a lubricant.

The binder may be used as necessary in order to improve the adhesiveness and coatability of the layer.

The binder resin is suitably selected depending on the intended purpose without any restriction. Specific examples thereof include starches, hydroxyethyl cellulose, methyl cellulose, carboxy methyl cellulose, gelatin, casein, gum arabic, polyvinyl alcohols, salts of diisobutylene/maleic anhydride copolymers, salts of styrene/maleic anhydride copolymers, salts of ethylene/acrylic acid copolymers, salts of styrene/acryl copolymers and emulsion salts of styrene/butadiene copolymers.

The filler is suitably selected depending on the intended purpose without any restriction. Examples thereof include inorganic pigments such as calcium carbonate, aluminum oxide, zinc oxide, titanium dioxide, silica, aluminum hydroxide, barium sulfate, talc, kaolin, alumina and clay, and commonly known organic pigments. In addition, when waterproofness (resistance against peeling off due to water) is taken into consideration, acidic pigments (those which exhibit acidity in aqueous solutions) such as silica, alumina and kaolin are preferable, with silica being particularly preferable from the viewpoint of developed color density.

The thermoplastic material is suitably selected depending on the intended purpose without any restriction. Examples thereof include: fatty acids such as stearic acid and behenic acid; fatty acid amides such as stearic acid amide, erucic acid amide, palmitic acid amide, behenic acid amide and palmitic acid amide; N-substituted amides such as N-lauryl lauric acid amide, N-stearyl stearic acid amide and N-oleyl stearic acid amid; bis fatty acid amides such as methylene bis stearic acid amide, ethylene bis stearic acid amide, ethylene bis lauric acid amide, ethylene bis capric acid amide and ethylene bis behenic acid amide; hydroxyl fatty acid amides such as hydroxyl stearic acid amide, methylene bis hydroxyl stearic acid amide, ethylene bis hydroxyl stearic acid amide and hexamethylene bis hydroxy stearic acid amide; metal salts of fatty acids, such as zinc stearate, aluminum stearate, calcium stearate, zinc palmitate and zinc behenate; p-benzyl biphenyl, terphenyl, triphenyl methane, benzyl p-benzyloxybenzoate, β-benzyloxy naphthalene, phenyl β-naphthoate, so 1-hydroxy-2-phenyl naphthoate, methyl 1-hydroxy-2-naphthoate, diphenyl carbonate, benzyl terephthalate, 1,4-dimethoxy naphthalene, 1,4-diethoxy naphthalene, 1,4-dibenzyloxy naphthalene, 1,2-diphenoxy ethane, 1,2-bis(4-methyl phenoxy ethane), 1,4-diphenoxy-2-butene, 1,2-bis(4-methoxy phenyl thio) ethane, dibenzoyl methane, 1,4-diphenylthio butane, 1,4-diphenylthio-2-butene, 1,3-bis(2-vinyloxy ethoxy) benzene, 1,4-bis (2-vinyloxy ethoxy) benzene, p-(2-vinyloxy ethoxy) biphenyl, p-aryloxy biphenyl, dibenzoyloxymethane, dibenzoyloxypropane, dibenzyl sulfide, 1,1-diphenyl ethanol, 1,1-diphenyl propanol, p-benzyloxy benzyl alcohol, 1,3-phenoxy-2-propanol, N-octadecyl carbamoyl-p-methoxy carbonyl benzene, N-octadecyl carbamoyl benzene, 1,2-bis(4-methoxyphenoxy) propane, 1,5-bis (4-methoxyphenoxy)-3-oxapentane, dibenzyl oxalate, bis(4-methyl benzyl) oxalate and bis(4-chlorobenzyl) oxalate. These may be used independently or in combination.

In recent years, fluorescent whitening agents have been included to whiten the background area and improve appearance. From the viewpoints of the effect of improving background whiteness and the stability of the protective layer liquid, diaminostilbene compounds are preferable.

Further, when N-aminopolyacryl amide serving as a crosslinking agent is added to the thermosensitive recording layer and the protective layer, preferably, diacetone-modified polyvinyl alcohol is incorporated into the thermosensitive recording layer. This is because a crosslinking reaction readily occurs, and waterproofness can be improved without adding another crosslinking agent that could impede color formation.

The thermosensitive recording layer can be formed though a commonly known method. For example, the leuco dye and developer have been pulverized and dispersed together with the binder and the other components so as to be a particle diameter of 1 μm to 3 μm by a disperser such as a ball mill, Atriter and sand mill. The resultant dispersion is mixed, if necessary, together with the filler and the hot-melt material (sensitizer) dispersion liquid in accordance with a predetermined formulation, to thereby prepare a thermosensitive recording layer-coating liquid. Subsequently, the thus-prepared coating liquid is used to form a layer on the support through simultaneous coating by a curtain coating method.

The thickness of the thermosensitive recording layer varies depending on the composition of the thermosensitive recording layer and intended use of the thermosensitive recording materials and cannot be specified flatly, but it is preferably 1 μm to 50 μm, more preferably 3 μm to 20 μm.

The first protective layer contains a water-soluble resin and a crosslinking agent, and may further contain other substances, as necessary.

The water-soluble resin (binder resin) and the crosslinking agent used in the first protective layer may be those identical to the water-soluble resin and the crosslinking agent used in the second protective layer. Among them, the water-soluble resin is preferably diacetone-modified polyvinyl alcohol.

Moreover, the first protective layer may contain an acrylic resin or maleic acid-based copolymer.

Examples of the acrylic resin and maleic acid copolymer contained in the first protective layer include the resins used in the second protective layer, and an acryl-based cationic polymer aqueous solution. Among them, a water-soluble salt of diisobutylene-maleic anhydride copolymer, and an acryl-based cationic polymer aqueous solution are particularly preferable.

Examples of the cationic group of the acryl-based cationic polymer aqueous solution include primary to tertiary amino group, imidazolyl group, pyridyl group, pyrimidinyl group, or salts thereof, quaternary ammonium salt group, sulfonium group, and phosphonium group.

The monomer to which the cationic group is introduced is suitably selected depending on the intended purpose without any restriction. Examples thereof include: trimethylammonium chloride, trimethyl-p-vinylbenzylamminoum chloride, tri ethyl-m-vinylbenzylammonium chloride, triethyl-p-vinylbenzylammonium chloride, triethyl-m-vinylbenzylammonium chloride, N,N-dimethyl-N-ethyl-N-p-vinylbenzylammonium chloride, N,N-diethyl-N-methyl-N-p-vinylbenzylammonium chloride, N,N-dimethyl-N-n-propyl-N-p-vinylbenzylammonium chloride, N,N-dimethyl-N-n-octyl-N-p-vinylbenzylammonium chloride, N,N-dimethyl-N-benzyl-N-p-vinylbenzylammonium chloride, N,N-diethyl-N-benzyl-N-p-vinylbenzylammonium chloride, N,N-dimethyl-N-(4-methyl)benzyl-N-p-vinylbenzylammonium chloride, N,N-dimethyl-N-phenyl-N-p-vinylbenzylammonium chloride, N,N-dimethylaminoethyl(meth)acrylate, N,N-diethylaminoethyl (meth)acrylate, N,N-dimethylaminopropyl (meth)acrylate, N,N-diethylaminopropyl (meth)acrylate, N,N-dimethylaminoethyl(meth)acrylamide, N,N-diethylaminoethyl (meth)acrylamide, N,N-dimethylaminopropyl (meth)acrylamide, and N,N-diethylaminopropyl (meth)acrylamide; quaternized products of methyl chloride, ethyl chloride, methyl bromide, ethyl bromide, methyl iodide, or ethyl iodide thereof; sulfonate, alkyl sulfonate, acetate, or alkyl carbonate, which are formed by replacing anion of the aforementioned compounds; diallyl amine, diallylmethyl amine, diallylethyl amine or salts thereof (e.g. chlorate, acetate, sulfate); diallyldimethyl ammonium salt (as the counter anion of the salt, chloride, acetic acid ion, sulfuric acid ion); and vinyl pyridine, N-vinyl imidazole, or salts thereof.

The second protective layer contains a water-soluble resin, a crosslinking agent, and a pigment, and may further contain other substances, as necessary.

Examples of the pigment include inorganic pigments such as aluminum hydroxide, zinc hydroxide, zinc oxide, titanium dioxide, calcium carbonate, silica, alumina, barium sulfate, clay, talc and kaoline. In particular, aluminum hydroxide and calcium carbonate exhibit good wear resistance to the thermal head for a long period of time.

The water-soluble resin (binder resin) is suitably selected depending on the intended purpose without any restriction. Examples thereof include polyvinyl alcohol, starch and derivatives thereof, cellulose derivatives such as methoxy cellulose, hydroxy ethyl cellulose, carboxy methyl cellulose, methyl cellulose and ethyl cellulose, polyacrylate soda, polyvinyl pyrrolidone, acryl amide/acrylate copolymers, acryl amide/acrylate/methacrylic acid terpolymers, alkali salts of styrene/maleic anhydride copolymers, alkali salts of isobutylene/maleic anhydride copolymers, polyacrylamide, alginate soda, gelatin and casein. Among them, polyvinyl alcohol containing a reactive carbonyl group is preferable and diacetone-modified polyvinyl alcohol is more preferable, as the resins having high thermal resistance, which is not easily hot melted or softened, is advantageous for the improvement in view of sticking.

The polyvinyl alcohol containing the reactive carbonyl group can be produced in the method known in the art, such as a method in which a vinyl monomer containing a reactive carbonyl group and fatty acid vinyl ester are copolymerized to form a polymer and the obtained polymer is saponificated.

As for the vinyl monomer containing the reactive carbonyl group, those containing a group including an ester bond, and a group containing an acetone group are listed as an example, but diacetone acrylamide, methdiacetone acrylamide and the like are used for obtaining diacetone-modified polyvinyl alcohol. Examples of the fatty acid vinyl ester include vinyl formate, vinyl acetate, and vinyl propionate, and among them, vinyl acetate is preferable.

The diacetone-modified polyvinyl alcohol may be the ones obtained by copolymerizing vinyl monomers. Examples of the vinyl monomer capable of copolymerizing include acrylate, butadiene, ethylene, propylene, acrylic acid, methacrylic acid, maleic acid, maleic anhydride, and itaconic acid.

The amount of the diacetone group contained in the diacetone-modified polyvinyl alcohol is about 0.5 mol % to about 20 mol % relative to the total amount of the polymer, preferably 2 mol % to 10 mol % in view of water proof property thereof. When the amount thereof is less than 2 mol %, the water proof property is practically insufficient. When the amount thereof is more than 10 mol %, the water proof property thereof would not improve further, and it becomes expensive.

The polymerization degree of the diacetone-modified polyvinyl alcohol is preferably 300 to 3,000, more preferably 500 to 2,200. Moreover, the degree of saponification is preferably 80% or more.

The crosslinking agent used in the second protective layer is suitably selected depending on the intended purpose without any restriction. Examples thereof include polyvalent amine compounds such as ethylene diamine; polyvalent aldehyde compounds such as glyoxal, glutalaldehyde and dialdehyde; dihydrazide compounds such as polyamideamine-epichlorohydrin, polyamide-epichlorohydrin, dihydrazide adipate and dihydrazide phthalate; water-soluble methylol compounds (urea, melamine and phenol); multifunctional epoxy compounds; multivalent metal salts (e.g., Al, Ti, Zr and Mg); titanium lactate; and boric acid. In addition, these may be used in combination with other commonly known crosslinking agents.

Moreover, the second protective layer contains an acrylic resin or maleic acid-based copolymer resin.

The acrylic resin contained in the second protective layer is suitably selected depending on the intended purpose without any restriction. Examples thereof include: a water soluble salt of ethylene-acrylic acid copolymer; a water soluble acrylic resin having, as a copolymerization component, ethyl acrylate, butyl acrylate, or 2-ethylhexyl acrylate; and a water soluble acrylic resin having, as a copolymerization component to the aforementioned copolymerization component, methacrylate, styrene, or acrylonitrile. Moreover, examples of the maleic acid-based copolymer resin include a water soluble salt of diisobutylene-maleic anhydride copolymer, and a water soluble salt of styrene-maleic anhydride copolymer. Among them, the water soluble salt of diisobutylene-maleic anhydride copolymer is particularly preferable.

Moreover, the acrylic resin and the maleic acid-based copolymer resin can attain the similar degree of the water proof effect of the printed image in either of a water soluble type thereof or emulsion type thereof. In the case where the emulsion type thereof is used, there is an adverse effect such that a barrier quality such as to anti-plasticizer, and oil resistance is deteriorated. Therefore, the use of the water soluble type thereof is preferable.

The amount of the acrylic resin and/or maleic acid-based copolymer resin is preferably 1 part by mass to 50 parts by mass with respect to 100 parts by mass of the binder resin. When the amount thereof is less than 1 part by mass, the printed image of an aqueous flexo ink may show no water proof property. When the amount thereof is more than 50 parts by mass, there may be a problem such that a sticking property is lowered in the low temperature low humidity condition.

Moreover, the second protective layer may contain aluminum hydroxide and/or calcium carbonate, or silicone resin particles, as basic filler. The aluminum hydroxide and calcium carbonate serving as the basic filler are in the form of particles, and the average particle diameter thereof is suitably selected depending on the intended purpose without any restriction. The average particle diameter thereof is preferably in the approximate range of 0.1 μm to 2 μm in view of the degree of the head matching property or coloring performance.

The silicone resin particles are formed by dispersing/curing silicone resin into fine powder, and are classified into spherical microparticles and amorphous powder.

The silicone resin may be a polymer containing a three-dimensional network structure with a siloxane bond as a main chain. There can be widely used those having as a side chain a methyl group, a phenyl group, a carboxyl group, a vinyl group, a nitrile group, an alkoxy group and a chlorine atom. In general, the silicone resin having a methyl group is used. The average particle diameter thereof is not particularly limited. Preferably, it is about 0.5 μm to about 10 μm, in consideration of improvement in head-matching property and/or color-developing property.

The thermosensitive recording material of the present invention preferably contains a back layer containing a pigment, a water soluble resin (binder resin) and a crosslinking agent, disposed on the surface of the support opposite to the surface thereof where the thermosensitive recording layer is disposed.

The hack layer may further contain other substances such as filler, a lubricant, and the like.

As for the binder resin, either of a water-dispersible resin or a water-soluble resin is used. Specific examples thereof include conventional water-soluble polymer, aqueous polymer emulsion, and the like.

The water-soluble polymer is suitably selected depending on the intended purpose without any restriction. Examples thereof include polyvinyl alcohol, starch and derivatives thereof, cellulose derivatives such as methoxy cellulose, hydroxy ethyl cellulose, carboxy methyl cellulose, methyl cellulose and ethyl cellulose, polyacrylate soda, polyvinyl pyrrolidone, acryl amide/acrylate copolymers, acryl amide/acrylate/methacrylic acid terpolymers, alkali salts of styrene/maleic anhydride copolymers, alkali salts of isobutylene/maleic anhydride copolymers, polyacrylamide, alginate soda, gelatin and casein. These may be used independently or in combination.

The aqueous polymer emulsion is suitably selected depending on the intended purpose without any restriction. Examples thereof include latexes of, for example, acrylate copolymers, styrene/butadiene copolymers and styrene/butadiene/acryl copolymers; and emulsions of, for example, a vinyl acetate resin, vinyl acetate/acrylate copolymers, styrene/acrylate copolymers, acrylate resins and polyurethane resins. These may be used independently or n combination.

The crosslinking agent may be those used in the second protective layer.

As for the filler, either inorganic filler or organic filler can be used. Examples of the inorganic filler include carbonates, silicates, metal oxides and sulfate compounds. Examples of the organic filler include silicone resins, cellulose resins, epoxy resins, nylon resins, phenol resins, polyurethane resins, urea resins, melamine resins, polyester resins, polycarbonate resins, styrene resins, acrylic resins, polyethylene resins, formaldehyde resins and polymethyl methacrylate resins.

The forming method of the back layer is suitably selected depending on the intended purpose without any restriction. However, the method in which a coating liquid of the back layer is applied on the web to form the back layer is preferable.

As for a thermosensitive recording label that is one usage example of the thermosensitive recording material, the first embodiment of the thermosensitive recording label has an adhesive layer and a release paper which are successively laminated on a back surface of the web or on the surface of the back layer of the thermosensitive recording material, and may have other structure, if necessary.

The materials for the adhesive layer can be appropriately selected in accordance with the intended purpose, examples thereof include urea resins, melamine resins, phenol resins, epoxy resins, vinyl acetate resins, vinyl acetate/acrylic copolymers, ethylene/vinyl acetate copolymers, acrylic resins, polyvinyl ether resins, vinyl chloride/vinyl acetate copolymers, polystyrene resins, polyester resins, polyurethane resins, polyamide resins, chlorinated polyolefin resins, polyvinyl butyral resins, acrylate copolymers, methacrylate copolymers, natural rubber, cyanoacrylate resins and silicone resins. These may be used independently or in combination.

As a second embodiment, the thermosensitive recording layer has a thermosensitive adhesive layer which develops adhesiveness by the action of heat and which is laid over the back layer or the back surface of the support of the thermosensitive recording material; and, if necessary, includes other components.

The thermosensitive adhesive layer contains a thermoplastic resin and a hot-melt material; and, if necessary, contains an adhesion-imparting agent. The thermoplastic resin provides the layer with viscosity and adhesiveness. The hot-melt material is a solid at room temperature and thus provides no plasticity. But it melts when heated, allowing the resin to swell and soften, thereby developing adhesiveness. Here, the adhesion-imparting agent has the action of increasing adhesiveness.

Thermosensitive recording magnetic paper, which is another usage form of the thermosensitive recording material, includes a magnetic recording layer over the back layer or the back surface of the support of the thermosensitive recording material; and, if necessary, includes other components.

The magnetic recording layer is formed on the support either by coating method using iron oxide and barium ferrite or the like together with vinyl chloride resin, urethane resin, nylon resin or the like, or by vapor deposition or sputtering without using resins.

The magnetic recording layer is preferably disposed on the surface of the web opposite to the surface thereof where the thermosensitive recording layer is disposed, but may be disposed between the web and the thermosensitive recording layer, or on a part of the thermosensitive recording layer.

(Apparatus for Producing Thermosensitive Recording Material)

The apparatus for producing a thermosensitive recording material of the present invention contains a curtain coating unit, which contains: a slit configured to eject a coating liquid for a thermosensitive recording material formed of at least two layers; a curtain guide edge configured to guide the ejected coating liquid, which is allowed to free-fall, in the form of a curtain: and a web which continuously travels and on which the coating liquid is applied, followed by drying so as to form a coated film, and the apparatus may further contain other units as necessary.

In the present invention, the dynamic surface tension A of the coating liquid of the thermosensitive recording layer and the dynamic surface tension B of the coating liquid of the layer adjacent to the thermosensitive recording layer has a difference (A–B) of 4 mN/m or less.

Figure 1:
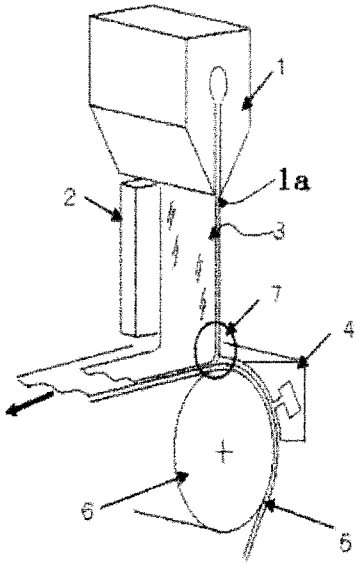
FIG. 1 is a schematic diagram showing an apparatus for producing a thermosensitive recording material in a curtain coating method of extrusion type.

As for the apparatus for producing a thermosensitive recording material, an apparatus having an extrusion curtain nozzle shown in FIG. 1, and an apparatus having a slide hopper curtain nozzle shown in FIG. 2 are suitably used. Among them, the apparatus having the slide hopper curtain nozzle is particularly preferable, from the reasons (1) the nozzle is easily processed with high accuracy, (2) bubbles within the nozzle are easily released as the liquid ejection outlet is directed upwards (in the case of the curtain coating, the bubbles in the coating liquid always cause coating defects), and (3) cleaning is easy after the completion of the coating as the liquid ejection outlet is directed upwards.

EXAMPLES

Examples of the present invention will be explained hereinafter, but these examples shall not be construed as limiting the scope of the present invention in any way.

In Examples mentioned later, the viscosity, static surface tension, and dynamic surface tension of the coating liquid were measured in the following manners.

<Viscosity>

The viscosity of the coating liquid was measured by means of a B-type viscometer (VISCOMETER MODEL: BL, manufactured by TOKYO KEIKI INC.) at 25° C.

<Measurement of Static Surface Tension>

The static surface tension of the coating liquid was measured by means of Full Automatic Surface Tensiometer (FACE) CBVP-A3 (manufactured by Kyowa Interface Science Co., Ltd.).

<Measurement of Dynamic Surface Tension>

The dynamic surface tension of the coating liquid was measured in accordance with a curtain splitting method in which a difference in the dynamic surface tension was directly measured using a curtain film (see Kistler and Schweizer, LIQUID FILM COATING, pp. 113-114, CHAPMAN&HALL).

Specifically, a curtain film was formed using a curtain die shown in FIGS. 3A and 3B, and the curtain film was split and the split angle was measured in the following conditions for forming a curtain film, and measuring position. Then, the dynamic surface tension was calculated based on the following mathematical formula 1.

Condition for forming a curtain film: 2 cc/(cm·sec)

Measuring position:

position in width direction: center in the die width direction position in height direction: position distant from the edge of the die lip by 50 mm $$\sigma = \frac{\rho Q}{2} V \sin^2 \alpha$$

Mathematical Formula 1

Note that, in the mathematical formula 1, σ denotes dynamic surface tension, ρ denotes liquid density, Q denotes a flow rate per unit width, V denotes falling velocity of the curtain at split point, and α denotes a split angle.

Example 1

(1) Preparation of a Coating Liquid of an Undercoat Layer [Liquid A]

| | |
|---|---|
| Plastic spherical hollow particles (vinylidene chloride-acrylonitrile copolymer (the molar ratio of 6/4), solid content concentration of 27.5%, average particle diameter of 3 μm, void ratio of 90%) | 36 parts by mass |
| Styrene-butadiene copolymer latex (SMARTEX PA-9159, manufactured by NIPPON A & L INC., solid content concentration of 47.5%) | 31 parts by mass |
| Water | 97 parts by mass |

The materials of the formulation above were mixed and stirred to thereby prepare a coating liquid of an undercoat layer [Liquid A].

The obtained coating liquid of the undercoat layer [Liquid A] had a viscosity of 30 mPa·s at 25° C., static surface tension of 41 mN/m, and dynamic surface tension of 67 mN/m.

(2) Preparation of a Coating Liquid of a Thermosensitive Recording Layer

[Liquid D]

[Liquid B]

| | |
|---|---|
| 2-anilino-3-methyl-6-(di-n-butylamino)fluoran | 20 parts by mass |
| 10% itaconic-modified polyvinyl alcohol (modification ratio of 1 mol %) aqueous solution | 20 parts by mass |
| Water | 60 parts by mass |

[Liquid C]

| | |
|---|---|
| 4-hydroxy-4'-isopropoxyphenylsulfone | 20 parts by mass |
| 10% itaconic-modified polyvinyl alcohol (modification ratio of 1 mol %) aqueous solution | 20 parts by mass |
| Silica | 10 parts by mass |
| Water | 50 parts by mass |

[Liquid B] and [Liquid C] having the aforementioned formulations respectively, were each dispersed by means of a sand mill so as to have an average particle diameter of 1.0 μm or less, to thereby prepare a dye dispersion [Liquid B] and a developer dispersion [Liquid C].

Then, [Liquid B] and [Liquid C] were mixed in the ratio of 1/7, the concentration of the solid content thereof was adjusted to 30%, then the mixture was stirred to thereby prepare a coating liquid of a thermosensitive recording layer [Liquid D].

The obtained coating liquid of the thermosensitive recording layer [Liquid D] had a viscosity of 250 mPa·s at 25° C., static surface tension of 38 mN/m, and dynamic surface tension of 64 mN/m.

(3) Preparation of a Coating Liquid of a First Protective Layer [Liquid E]

| | |
|---|---|
| (a) 10% diacetone-modified polyvinyl alcohol (modification ratio of 4 mol %) aqueous solution | 120 parts by mass |
| (b) 10% adipic acid dihydrazide aqueous solution | 10 parts by mass |
| Sodium sulfonate, a surfactant | 0.021% by mass with respect to total mass of (a) and (b) |

The materials of the aforementioned formulation were mixed and stirred to thereby prepare a coating liquid of a first protective layer [Liquid E].

The obtained coating liquid of the first protective layer [Liquid E] had a viscosity of 300 mPa·s at 25° C., static surface tension of 35 mN/m, and dynamic surface tension of 60 mN/m.

(4) Preparation of a Coating Liquid of a Second Protective Layer [Liquid G]

[Liquid F]

| | |
|---|---|
| Aluminum hydroxide (HIGILITE H-43M, manufactured by SHOWA DENKO K.K., average particle diameter of 0.6 μm) | 20 parts by mass |
| 18% itaconic-modified polyvinyl alcohol (modification ratio of 1 mol %) aqueous solution | 11 parts by mass |
| Water | 35 parts by mass |

The materials of the aforementioned formulation were dispersed by means of a sand mill for 24 hours, to thereby prepare [Liquid F].

[Liquid G]

| | |
|---|---|
| [Liquid F] | 150 parts by mass |
| 18% diacetone-modified polyvinyl alcohol (modification ratio of 4 mol %) aqueous solution | 60 parts by mass |
| 10% adipic acid dihydrazide aqueous solution | 10 parts by mass |
| Water | 10 parts by mass |

The materials of the aforementioned formulation was mixed and stirred to thereby prepare a coating liquid of a second protective layer [Liquid G].

The obtained coating liquid of the second protective layer [Liquid G] had a viscosity of 330 mPa·s at 25° C., static surface tension of 29 mN/m, and dynamic surface tension of 40 mN/m.

Next, the coating liquid of the undercoat layer [Liquid A] was applied on a base paper support (wood-free water having basis weight of 60 g/m$^2$) by a rod bar so as to have a deposition amount of 2.0 g/m$^2$ on dry basis, and then dried. Thereafter, using an apparatus for producing a thermosensitive recording material equipped with a slide hopper curtain nozzle shown in FIG. 2, the coating liquid of the thermosensitive recording layer [Liquid D], the coating liquid of the first protective layer [Liquid E], and the coating liquid of the second protective layer [Liquid G] were continuously and simultaneously applied on the surface of the web (moisture content of 6%, smoothness of 400 sec.) by means of a curtain coater at the speed of 600 m/min. so as to have the deposition amounts of 3.0 g/m$^2$, 1.0 g/m$^2$, and 1.0 g/m$^2$, respectively, on dry basis, to thereby prepare a thermosensitive recording material.

Example 2

A thermosensitive recording material was prepared in the same manner as Example 1, provided that the coating liquid of the first protective layer was changed as follow.

—Preparation of a Coating Liquid of a First Protective Layer—

The materials of the following formulation were mixed and stirred to thereby prepare a coating liquid of a first protective layer [Liquid E].

| | |
|---|---|
| (a) 10% diacetone-modified polyvinyl alcohol (modification ratio of 4 mol %) aqueous solution | 120 parts by mass |
| (b) 10% adipic acid dihydrazide aqueous solution | 10 parts by mass |
| Sodium sulfonate, a surfactant | 0.019% by mass with respect to total mass of (a) and (b) |

The obtained coating liquid of the first protective layer [Liquid E] had a viscosity of 300 mPa·s at 25° C., static surface tension of 35.5 mN/m, and dynamic surface tension of 61.5 mN/m.

Example 3

A thermosensitive recording material was prepared in the same manner as in Example 1, provided that the coating liquid of the first protective layer was changed as follow.

—Preparation of a Coating Liquid of a First Protective Layer—

The materials of the following formulation were mixed and stirred to thereby prepare a coating liquid of a first protective layer [Liquid E].

| | |
|---|---|
| (a) 10% diacetone-modified polyvinyl alcohol (modification ratio of 4 mol %) aqueous solution | 120 parts by mass |
| (b) 10% adipic acid dihydrazide aqueous solution | 10 parts by mass |
| Sodium sulfonate, a surfactant | 0.017% by mass with respect to total mass of (a) and (b) |

The obtained coating liquid of the first protective layer [Liquid E] had a viscosity of 300 mPa·s at 25° C., static surface tension of 36 mN/m, and dynamic surface tension of 63 mN/m.

Example 4

A thermosensitive recording material was prepared in the same manner as in Example 1, provided that the coating liquid of the first protective layer was changed as follow.

—Preparation of a Coating Liquid of a First Protective Layer—

The materials of the following formulation were mixed and stirred to thereby prepare a coating liquid of a first protective layer [Liquid E].

| | |
|---|---|
| (a) 10% diacetone-modified polyvinyl alcohol (modification ratio of 4 mol %) aqueous solution | 120 parts by mass |
| (b) 10% adipic acid dihydrazide aqueous solution | 10 parts by mass |
| Sodium sulfonate, a surfactant | 0.0165% by mass with respect to total mass of (a) and (b) |

The obtained coating liquid of the first protective layer [Liquid E] had a viscosity of 300 mPa·s at 25° C., static surface tension of 37.5 mN/m, and dynamic surface tension of 63.5 mN/m.

Comparative Example 1

A thermosensitive recording material was prepared in the same manner as in Example 1, provided that the coating liquid of the first protective layer was changed as follow.

—Preparation of a Coating Liquid of a First Protective Layer—

[Liquid E]

| | |
|---|---|
| (a) 10% diacetone-modified polyvinyl alcohol (modification ratio of 4 mol %) aqueous solution | 120 parts by mass |
| (b) 10% adipic acid dihydrazide aqueous solution | 10 parts by mass |
| Sodium sulfonate, a surfactant | 0.024% by mass with respect to total mass of (a) and (b) |

The materials of the aforementioned formulation were mixed and stirred to thereby prepare a coating liquid of a first protective layer The obtained coating liquid of the first protective layer [Liquid E] had a viscosity of 300 mPa·s at 25° C., static surface tension of 33 mN/m, and dynamic surface tension of 59 mN/m.

Comparative Example 2

A thermosensitive recording material was prepared in the same manner as in Example 1, provided that the coating liquid of the first protective layer was changed as follow.

—Preparation of a Coating Liquid of a First Protective Layer—

[Liquid E]

| | |
|---|---|
| (a) 10% diacetone-modified polyvinyl alcohol (modification ratio of 4 mol %) aqueous solution | 120 parts by mass |
| (b) 10% adipic acid dihydrazide aqueous solution | 10 parts by mass |
| Sodium sulfonate, a surfactant | 0.0255% by mass with respect to total mass of (a) and (b) |

The materials of the aforementioned formulation were mixed and stirred to thereby prepare a coating liquid of a first protective layer The obtained coating liquid of the first protective layer [Liquid E] had a viscosity of 300 mPa·s at 25° C., static surface tension of 32 mN/m, and dynamic surface tension of 58 mN/m.

Comparative Example 3

A thermosensitive recording material was prepared in the same manner as in Example 1, provided that the coating liquid of the first protective layer was changed as follow.

—Preparation of a Coating Liquid of a First Protective Layer—

[Liquid E]

| | |
|---|---|
| (a) 10% diacetone-modified polyvinyl alcohol (modification ratio of 4 mol %) aqueous solution | 120 parts by mass |
| (b) 10% adipic acid dihydrazide aqueous solution | 10 parts by mass |
| Sodium sulfonate, a surfactant | 0.027% by mass with respect to total mass of (a) and (b) |

The materials of the aforementioned formulation were mixed and stirred to thereby prepare a coating liquid of a first protective layer.

The obtained coating liquid of the first protective layer [Liquid E] had a viscosity of 300 mPa·s at 25° C., static surface tension of 31 mN/m, and dynamic surface tension of 57 mN/m.

Next, the thermosensitive recording materials of Examples 1 to 4, and Comparative Examples 1 to 3 were respectively subjected to the measurement of white spots occurrence. The results are shown in Table 1.

<Measuring Method of the Number of Occurred White Spots>

To each of the thermosensitive recording materials of Examples 1 to 4, and Comparative Examples 1 to 3, the coating liquid was applied with the coating width of 1,000 mm and the coating length of 16,000 m, then a number of white spots were counted by means of a defect detector (Max Eye. F, manufactured by FUTEC INC.).

TABLE 1

| | Dynamic surface tension (mN/m) | | | Occurrence of white spots |
|---|---|---|---|---|
| | A | B | (A − B) | (number) |
| Ex. 1 | 64 | 60 | 4 | 0 |
| Ex. 2 | 64 | 61.5 | 2.5 | 0 |
| Ex. 3 | 64 | 63 | 1.0 | 0 |
| Ex. 4 | 64 | 63.5 | 0.5 | 0 |
| Comp. Ex. 1 | 64 | 59 | 5 | 5 |
| Comp. Ex. 2 | 64 | 58 | 6 | 12 |
| Comp. Ex. 3 | 64 | 57 | 7 | 21 |

Note that, in Table 1, A denotes the dynamic surface tension of the coating liquid of the thermosensitive recording layer, B denotes the dynamic surface tension of the coating liquid of the first protective layer, and A−B denotes a difference in the dynamic surface tension between the coating liquid of the thermosensitive recording layer and the coating liquid of the first protective layer.

What is claimed is:

1. A method for producing a thermosensitive recording material, comprising:

ejecting a coating liquid for a thermo sensitive recording material from a slit, the coating liquid being formed of at least a lower layer and an upper layer adjacent the lower layer;

allowing the ejected coating liquid to free-fall while guiding the ejected coating liquid in the form of a curtain with a curtain edge guide;

applying the coating liquid on a web which continuously travels; and drying the applied coating liquid so as to form a coated film, wherein the method uses a curtain coating method, one of the lower layer and the upper layer contains a first coating liquid portion for forming a thermosensitive recording layer and another of the lower layer and the upper layer contains a second coating liquid portion for forming a layer adjacent to the thermosensitive recording layer which includes a water-soluble resin and a crosslinking agent, a dynamic surface tension of the upper layer is less than a dynamic surface tension of the lower layer, dynamic surface tension A of the first coating liquid portion free falling towards the web to form the thermosensitive recording layer and dynamic surface tension B of the second coating liquid portion free falling towards the web to form the layer adjacent to the thermosensitive recording layer has a difference (A−B) of 4 mN/m or less, and each dynamic surface tension amongst the dynamic surface tension A of the first coating liquid portion and the dynamic surface tension B of the second coating liquid portion is determined by applying a curtain splitting method to split the free falling curtain into two curtain portions, measuring a split angle between the two curtain portions and calculating the dynamic surface tension based on the split angle, liquid density of the coating liquid, and flow rate per unit width of the curtain.

2. The method for producing a thermosensitive recording material according to claim 1, wherein the coating liquid free-falling in the form of the curtain contains the first coating liquid portion for forming the thermosensitive recording layer and the second coating liquid portion for forming the layer adjacent to the thermosensitive recording layer in this order from a side of a lower layer, and the coating liquid is applied so that the dynamic surface tension A of the first coating liquid portion for forming the thermosensitive recording layer and the dynamic surface tension B of the second coating liquid portion for forming the layer adjacent to the thermosensitive recording layer has a difference (A−B) of 4 mN/m or less.

3. The method for producing a thermosensitive recording material according to claim 1, wherein the coating liquid for the thermosensitive recording material contains a coating liquid for three or more layers, including the thermosensitive recording layer, and the coating liquid is applied in accordance with a multilayer simultaneous curtain coating method.

* * * * *